US008607609B2

(12) United States Patent
Norikura

(10) Patent No.: US 8,607,609 B2
(45) Date of Patent: Dec. 17, 2013

(54) ROLLING MILL AND TANDEM ROLLING MILL HAVING THE SAME

(75) Inventor: Takashi Norikura, Tokyo (JP)

(73) Assignee: Mitsubishi-Hitachi Metals Machinery, Inc., Tokyo (JP)

( * ) Notice: Subject to any disclaimer, the term of this patent is extended or adjusted under 35 U.S.C. 154(b) by 603 days.

(21) Appl. No.: 12/812,200

(22) PCT Filed: Jan. 15, 2009

(86) PCT No.: PCT/JP2009/050409

§ 371 (c)(1),
(2), (4) Date: Sep. 9, 2010

(87) PCT Pub. No.: WO2009/093509

PCT Pub. Date: Jul. 30, 2009

(65) Prior Publication Data

US 2011/0023572 A1 Feb. 3, 2011

(30) Foreign Application Priority Data

Jan. 25, 2008 (JP) ..... 2008-014469

(51) Int. Cl.
*B21B 13/14* (2006.01)
*B21B 29/00* (2006.01)

(52) U.S. Cl.
USPC ..... 72/243.4; 72/241.2; 72/243.2

(58) Field of Classification Search
USPC ..... 72/224, 234, 241.2, 243.2, 243.4, 72/241.4, 241.6, 241.8, 242.2, 243.6, 247
See application file for complete search history.

(56) References Cited

U.S. PATENT DOCUMENTS 4,532,394 A * 7/1985 Fox et al. ..... 200/275
5,119,656 A * 6/1992 Kobayashi et al. ..... 72/241.8

(Continued)

FOREIGN PATENT DOCUMENTS

DE 102 08 389 A1 6/2003
EP 0 534 602 A2 3/1993

(Continued)

OTHER PUBLICATIONS

Monthly Magazine Industrial Machine (May 1991), pp. 56-60. Published by the Japan Society of Industry Machinery Manufacturers.

(Continued)

*Primary Examiner* — Teresa M Ekiert
(74) *Attorney, Agent, or Firm* — Birch, Stewart, Kolasch & Birch, LLP

(57) ABSTRACT

A rolling mill, which can use work rolls of a smaller diameter for rolling a hard material and a thin strip material, and can decrease edge drops and improve surface gloss, is provided. For this purpose, a rolling mill, which includes upper and lower work rolls (2) as a pair for rolling a strip (1), upper and lower intermediate rolls (3) as a pair for supporting the upper and lower work rolls as the pair, and upper and lower back-up rolls (4) as a pair for supporting the upper and lower intermediate rolls as the pair, is configured such that the upper and lower work rolls as the pair are supported by a plurality of supporting bearings (8*a* to 8*f* and 9*a* to 9*f*) arranged vertically zigzag on an entry side in a rolling direction, and a plurality of supporting bearings (10*a* to 10*f* and 11*a* to 11*f*) arranged vertically zigzag on an delivery side in the rolling direction, at positions outward of a rollable strip width, and the plurality of supporting bearings lap over each other vertically.

6 Claims, 10 Drawing Sheets

(56) References Cited

U.S. PATENT DOCUMENTS

| | | | | |
|---|---|---|---|---|
| 5,799,527 | A * | 9/1998 | Kenmochi et al. | 72/252.5 |
| 6,230,534 | B1 | 5/2001 | Sato et al. | |
| 2002/0043087 | A1 | 4/2002 | Kobayashi et al. | |

FOREIGN PATENT DOCUMENTS

| | | | |
|---|---|---|---|
| JP | 60-18206 | A | 1/1985 |
| JP | 63-60005 | A | 3/1988 |
| JP | 63-58050 | B2 | 11/1988 |
| JP | 5-50109 | A | 3/1993 |
| JP | 05317917 | A * | 12/1993 |
| JP | 11-33602 | A | 2/1999 |
| JP | 2002-66608 | A | 3/2002 |
| JP | 3382874 | B2 | 3/2003 |

OTHER PUBLICATIONS

European Search Report dated Jun. 24, 2013 for EP Application No. 09 70 3122.

* cited by examiner

ROLLING MILL AND TANDEM ROLLING MILL HAVING THE SAME

TECHNICAL FIELD

This invention relates to a rolling mill, which can render the diameter of work rolls small, and a tandem rolling mill equipped with the rolling mill.

BACKGROUND ART

In a conventional so-called intermediate roll-drive six-high rolling mill (hereinafter referred to as a six-high mill), the minimum value of the work roll diameter is determined by the flexural rigidity value of the work rolls, which withstands the tangential force of the intermediate roll drive, if there are no support rolls on portions of the work rolls inside and outside the rollable strip width of the work rolls. According to Non-Patent Document 1, for example, this value is 180 mm to 380 mm in the case of a 4-feet width material upon the intermediate roll drive.

A conventional six-high mill may have support rolls inside the rollable strip width of the work rolls. Further, a six-high mill, which has support bearings provided outside the rollable strip width of the work rolls, and applies horizontal bending to the work rolls via these support bearings, is disclosed in Patent Document 1.

Non-Patent Document 1: "Industrial Machinery", May Issue, 1991 (pp. 56-60)

Patent Document 1: JP-A-5-50109

DISCLOSURE OF THE INVENTION

Problems to be Solved by the Invention

To meet recent needs, an attempt has been made to roll a special steel, such as a harder stainless steel, by a six-high mill having no support rolls inside the rollable strip width of the work rolls. This attempt has posed a problem such that the aforementioned work roll diameter is too large and imposes a heavy load, thus failing to ensure a necessary reduction in thickness by rolling, and a problem such as poor gloss.

On the other hand, a six-high mill having support rolls inside the rollable strip width of the work rolls has involved the following problems: A space for the support roll portion is so small that sufficient strength and rigidity are difficult to ensure. Since there are support bearings for supporting the support rolls inside the rollable strip width of the work roll, moreover, marks of the support bearings are transferred to or produced in the strip via the support rolls and the work rolls, depending on their material.

A rolling mill having supporting bearings provided outside the rollable strip width of the work rolls has the problems that since the upper and lower supporting bearings are of the same phase, the bearings of a large size cannot be used, and the bearings applied cannot be adopted for heavy load, high torque rolling of a hard material which causes a great horizontal force.

The present invention has been accomplished in the light of these circumstances. It is an object of the present invention to provide a rolling mill, which can render work rolls of a smaller diameter usable for the purpose of rolling a hard material, and can thereby obtain a strip with high productivity and of high product quality, and a tandem rolling mill equipped with the rolling mill.

Means for Solving the Problems

The rolling mill according to the present invention, intended to solve the above-mentioned problems, is a six-high rolling mill including upper and lower work rolls as a pair for rolling a metal strip, upper and lower intermediate rolls as a pair for supporting the work rolls, and upper and lower back-up rolls as a pair for supporting the upper and lower intermediate rolls as the pair, the six-high rolling mill having no supporting rolls inside a rollable strip width of the work rolls, the six-high rolling mill comprising a plurality of supporting rollers or supporting bearings provided at predetermined spacings in a roll axis direction on both of an entry side and an delivery side on an operating side and a drive side outside the rollable strip width of the upper and lower work rolls as the pair such that the supporting rollers or supporting bearings are arranged vertically zigzag between the upper and lower work rolls as the pair.

The rolling mill is also characterized in that a minimum roll diameter of the work roll is intermediate between a minimum diameter upper limit Dmax1 and a minimum diameter lower limit Dmin1, and these parameters are expressed by the following equations:

$$\text{minimum diameter upper limit } Dmax1 = D4max \times B/5^{(1/4)}$$

where D4max; minimum diameter upper limit of conventional work roll with strip width of 1,300 mm: 380 mm B; strip width (mm)/1,300 mm minimum diameter lower limit $Dmin1 = D4min \times B/5^{(1/4)}$ where D4min; minimum diameter lower limit of conventional work roll with strip width of 1,300 mm: 180 mm The rolling mill is also characterized in that a material having a high modulus of longitudinal elasticity is used for the work roll, and a minimum roll diameter of the work roll is intermediate between a minimum diameter upper limit Dmax2 and a minimum diameter lower limit Dmin2, and these parameters are expressed by the following equations:

$$\text{minimum diameter upper limit } Dmax2 = D4max \times B/(5 \times K)^{(1/4)}$$

where D4max; minimum diameter upper limit of conventional work roll with strip width of 1,300 mm: 380 mm B; strip width (mm)/1,300 mm K; ratio for modulus of longitudinal elasticity of high longitudinal modulus material to conventional material (modulus of longitudinal elasticity of high longitudinal modulus material/modulus of longitudinal elasticity of conventional material (21,000 kg/mm$^2$))

minimum diameter lower limit $Dmin2 = D4min \times B/(5 \times K)^{(1/4)}$ where D4min; minimum diameter lower limit of conventional work roll with strip width of 1,300 mm: 180 mm The tandem rolling mill according to the present invention, intended to solve the aforementioned problems, is a tandem rolling mill including a plurality of rolling mill stands arranged therein, wherein any one of the above-mentioned rolling mills is provided as at least one of the stands.

Effects of the Invention

According to the features of the present invention, the supporting rollers or the supporting bearings arranged vertically zigzag are provided on both of the entry side and the delivery side outside the rollable strip width of the upper and lower work rolls as the pair so that the supports for both ends of the work rolls will correspond to fixed supports changed from simple supports. By so doing, the deflection of the work roll, which occurs under the tangential force of the intermediate roll drive, can be suppressed. As a result, the diameter of the work roll can be rendered small, edge drops can be decreased, and surface gloss can be improved.

Compared with a rolling mill having supporting rollers or supporting bearings of the same phase provided vertically outside the rollable strip width of the work rolls, moreover, the upper and lower supporting rollers or supporting bearings arranged zigzag can lap over each other. Thus, supporting rollers or supporting bearings large in size and capacity can be applied, with the result that they can be applied to a heavy load, high torque rolling mill for a hard material.

Since the work roll composed of a hard metal or ceramic material which is a high longitudinal modulus material is used, moreover, the diameter of the work roll can be rendered even smaller.

DESCRIPTION OF THE NUMERALS

1 Strip
2 Work roll
3 Intermediate roll
4 Back-up roll
5*a*, 5*b* Pass line adjusting device
6*a*, 6*b* Hydraulic cylinder
7*a*, 7*b* Housing
8*a* to 8*f* and 9*a* to 9*f* A plurality of supporting bearings arranged vertically zigzag on entry side in rolling direction
10*a* to 10*f* and 11*a* to 11*f* A plurality of supporting bearings arranged vertically zigzag on delivery side in rolling direction
13*a* to 13*d* Work roll bearing housing
15*a* to 15*d* Intermediate roll bearing housing
17*a* to 17*d*, 19*a* to 19*d* Back-up roll bearing housing
14*a* to 14*d* Work roll bending cylinder
16*a* to 16*d* Intermediate roll bending cylinder

BEST MODE FOR CARRYING OUT THE INVENTION

A rolling mill and a tandem rolling mill equipped therewith, according to the present invention, will be described in detail by the following embodiments using drawings.

Embodiment 1

Figure 1:
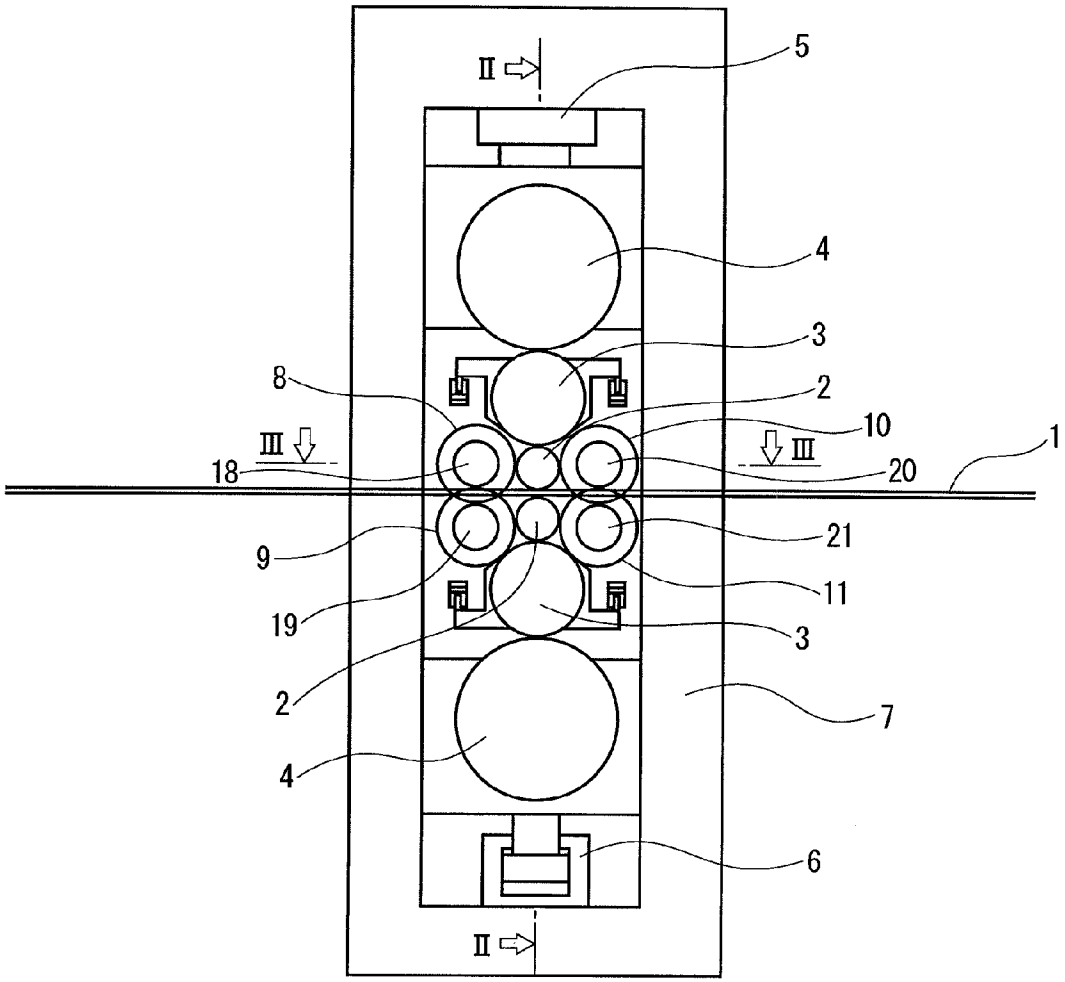
FIG. 1 is a front sectional view of a six-high mill showing Embodiment 1 of the present invention.
Figure 2:
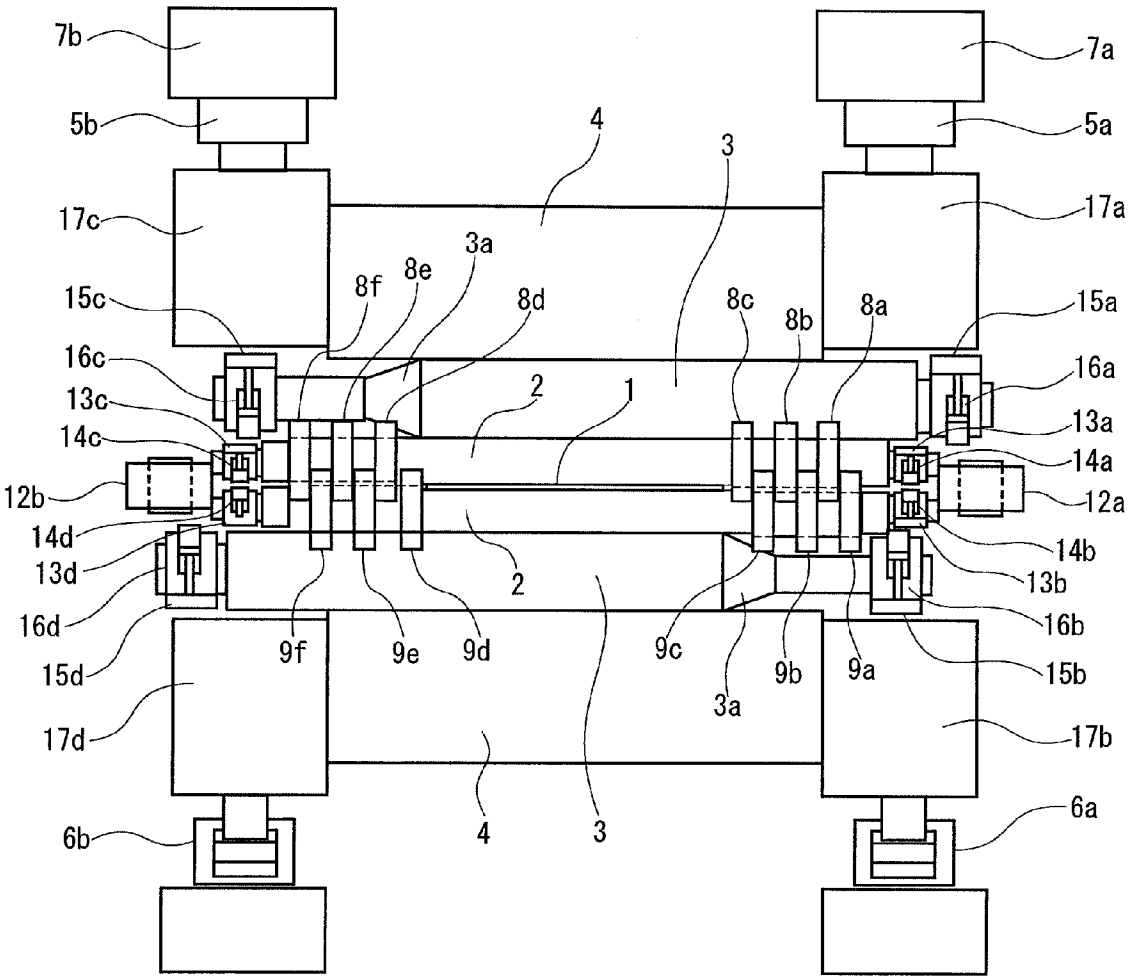
FIG. 2 is a sectional view taken along line II-II in FIG. 1.
Figure 3:
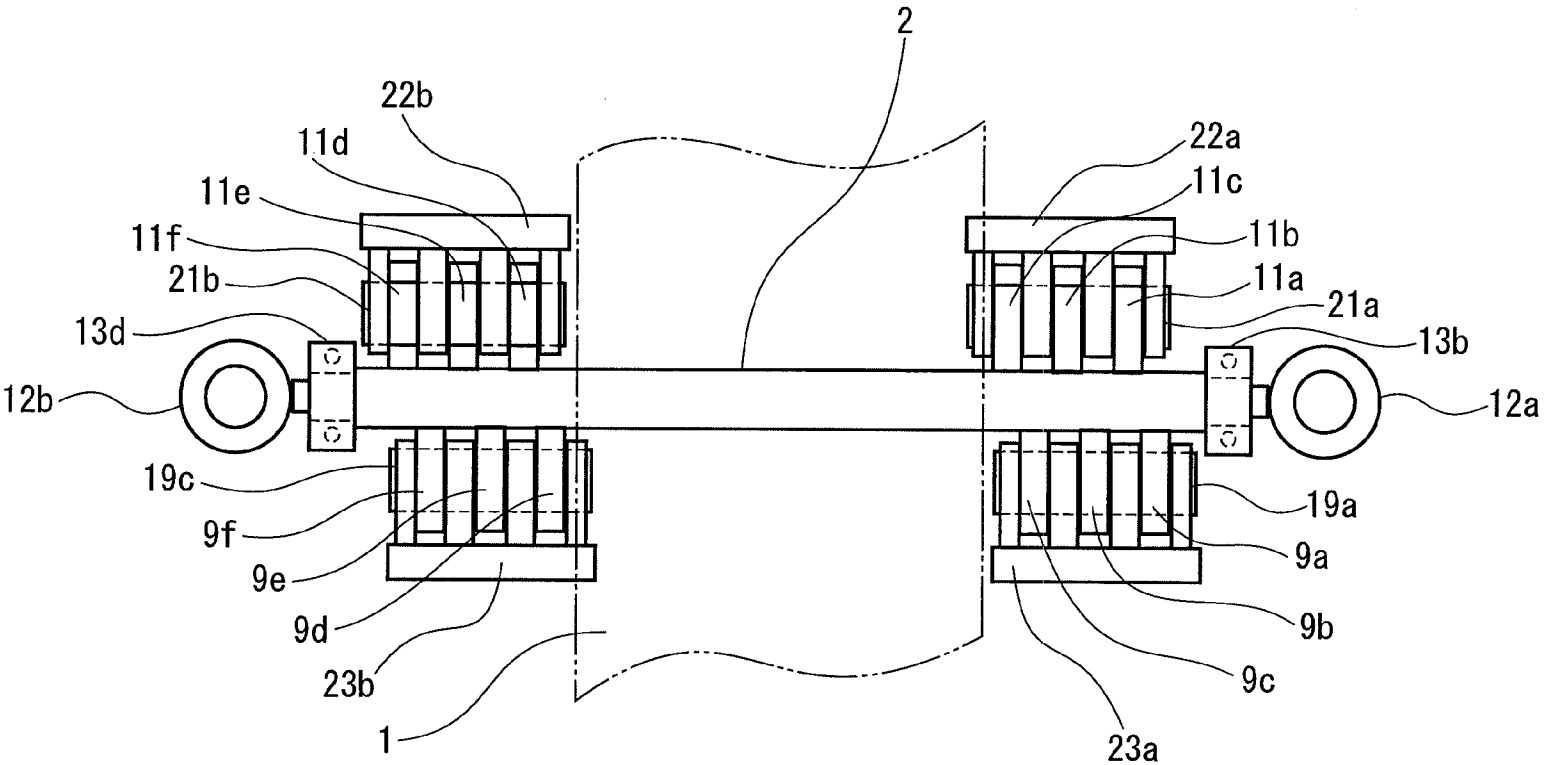
FIG. 3 is a sectional view taken along line in FIG. 2.

FIG. 1 is a front sectional view of a six-high mill showing Embodiment 1 of the present invention. FIG. 2 is a sectional view taken along line II-II in FIG. 1. FIG. 3 is a sectional view taken along line in FIG. 2.

As shown in the drawings, a strip 1, which is a material to be rolled, is rolled by upper and lower work rolls 2 as a pair. These upper and lower work rolls 2 as the pair are in contact with, and supported by, upper and lower intermediate rolls 3 as a pair. These upper and lower intermediate rolls 3 as the pair are in contact with, and supported by, upper and lower back-up rolls 4 as a pair.

The upper back-up roll 4 is supported by bearing housings 17*a*, 17*c* via bearings (not shown), and these bearing housings 17*a*, 17*c* are supported by housings 7*a*, 7*b* via pass line adjusting devices 5*a*, 5*b* such as worm jacks or taper wedges and stepped rocker plates. Here, load cells may be incorporated inside the pass line adjusting devices 5*a*, 5*b* to measure a rolling load.

The lower back-up roll 4 is supported by bearing housings 17*b*, 17*d* via bearings (not shown), and these bearing housings 17*b*, 17*d* are supported by the housings 7*a*, 7*b* via hydraulic cylinders 6*a*, 6*b*.

The upper and lower work rolls 2 as the pair are supported by a plurality of supporting bearings 8*a* to 8*f* and 9*a* to 9*f* arranged vertically zigzag on the entry side in a rolling direction outside a rollable strip width, and further by a plurality of supporting bearings 10*a* to 10*f* and 11*a* to 11*f* arranged vertically zigzag on the delivery side in the rolling direction outside the rollable strip width.

These plural supporting bearings are mounted, respectively, on brackets 22, 23 via shafts 18, 19 and 20, 21, and the brackets 22, 23 are further mounted on the housings 7. These plural supporting bearings 8*a* to 8*f* and 9*a* to 9*f* arranged vertically zigzag on the entry side in the rolling direction are structured to lap over each other vertically. Moreover, the plural supporting bearings 10*a* to 10*f* and 11*a* to 11*f* arranged vertically zigzag on the delivery side in the rolling direction are structured to lap over each other vertically.

The upper and lower work rolls 2 as the pair are provided, at both shaft ends thereof, with thrust bearings 12*a*, 12*b* for undergoing an axial thrust force. Further, bearing housings 13*a* to 13*d* are mounted on roll neck portions of the upper and lower work rolls 2 as the pair via bearings (not shown). These bearing housings 13*a* to 13*d* are furnished with bending cylinders 14*a* to 14*d* for imparting roll bending. By so doing, roll bending is imparted to the upper and lower work rolls 2 as the pair. Here, the present embodiment shows a case where the bearing housings 13*a* to 13*d* are present, but these bearing housings 13*a* to 13*d* may be absent. The work rolls 2 without the bearing housings 13*a* to 13*d* are advantageous in that their structure is simple and they have good work efficiency.

Here, the rolling load is imparted by the hydraulic cylinders 6*a*, 6*b*, and rolling torque is transmitted by the intermediate roll 3 by a spindle (not shown). The upper and lower intermediate rolls 3 as the pair have roll shoulders 3*a*, whose roll diameter decreases, at the positions of the roll barrel ends in vertical point symmetry with respect to the center of the plate width of the strip 1.

The upper and lower intermediate rolls 3 as the pair are supported by bearing housings 15*a* to 15*d* via bearings (not shown). The upper and lower intermediate rolls 3 as the pair are axially movable by shifting devices (not shown) via the drive-side bearing housings 15*c*, 15*d*. Further, these bearing housings 15*a* to 15*d* are furnished with bending cylinders 16*a* to 16*d* for imparting roll bending. By so doing, roll bending is imparted to the intermediate rolls 3.

The supporting bearings 8*a* to 8*f* and 9*a* to 9*f* arranged vertically zigzag on the entry side in the rolling direction and the supporting bearings 10*a* to 10*f* and 11*a* to 11*f* arranged vertically zigzag on the delivery side in the rolling direction may be shifted in the roll axis direction in agreement with the plate width of the strip 1. That is, if the strip width is small, the spacing between the supporting bearings arranged vertically zigzag on the operating side and those on the drive side may be narrowed on the entry side and the delivery side in conformity with the plate width. In this case, the support spacing is small, and is thus advantageous in that the deflection of the upper and lower work rolls 2 as the pair is suppressed.

In the present embodiment, as describe above, the supporting bearings 8*a* to 8*f* and 9*a* to 9*f* and 10*a* to 10*f* and 11*a* to 11*f*, which are arranged vertically zigzag, are provided on both of the entry side and the delivery side outside the rollable strip width of the upper and lower work rolls 2 as the pair. Thus, the deflection of the work roll 2, which occurs under the tangential force of the intermediate roll drive, can be suppressed. As a result, the diameter of the work roll can be rendered small.

Moreover, the zigzag arrangement allows the upper and lower supporting bearings 8*a* to 8*f* and 9*a* to 9*f*, 10*a* to 10*f* and 11*a* to 11*f* to lap over each other. Thus, the supporting bearings large in size and capacity become applicable. Consequently, they can be applied to a heavy load, high torque rolling mill for a hard material.

As a result, the work roll 2 of a smaller diameter can be used for rolling of a hard material, the strip 1 of a high product quality can be obtained in an attempt to decrease edge drops and improve surface gloss, and a high productivity can be obtained.

Embodiment 2

Next, Embodiment 2 of the present invention will be described.

The characteristic of the present embodiment is that a material having a high modulus of longitudinal elasticity is used for the upper and lower work rolls 2 as the pair in Embodiment 1 mentioned above. An example of the material having a high modulus of longitudinal elasticity is a hard metal such as tungsten carbide (modulus of longitudinal elasticity: 53,000 kg/mm$^2$), or a ceramic (modulus of longitudinal elasticity: 31,000 kg/mm$^2$).

In the present embodiment, as describe above, the supporting bearings arranged vertically zigzag are provided on both of the entry side and the delivery side outside the rollable strip width of the upper and lower work rolls 2 as the pair, and the work roll 2 composed of a hard metal or ceramic material with a high modulus of longitudinal elasticity is used. Thus, the diameter of the work roll can be rendered even smaller, and the strip 1 of high product quality can be obtained with high productivity by the rolling of a hard material.

In connection with Embodiment 1, deflection of the work roll by the driving tangential force will be described using FIG. 4, FIG. 5A and FIG. 5B.

Figure 4:
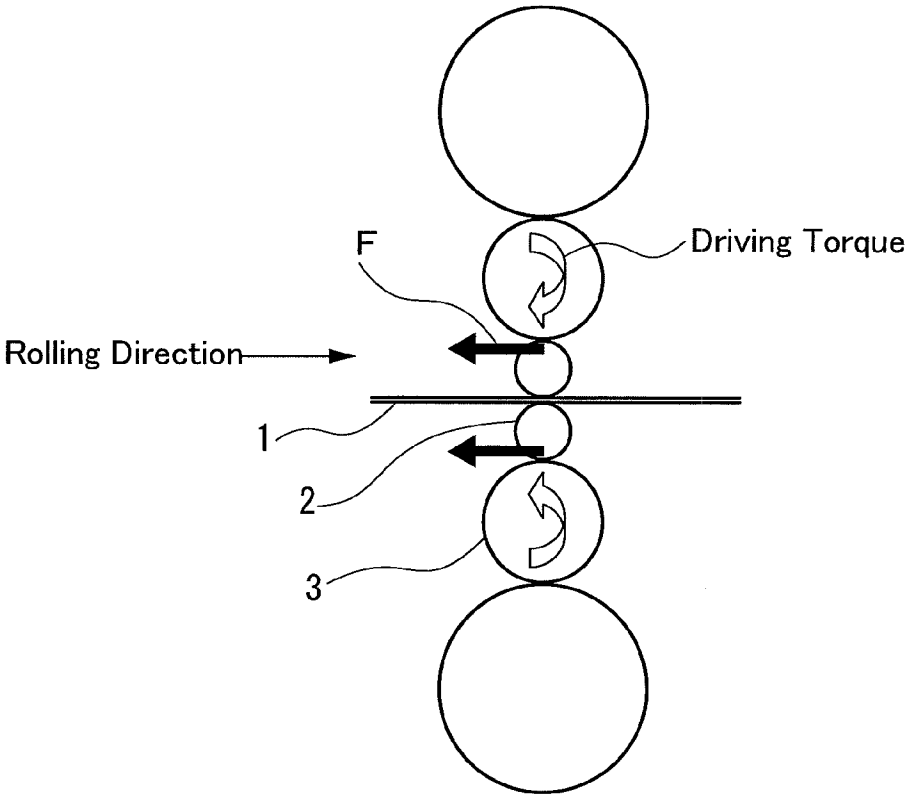
FIG. 4 is an explanation drawing of a driving tangential force.
Figure 5A:
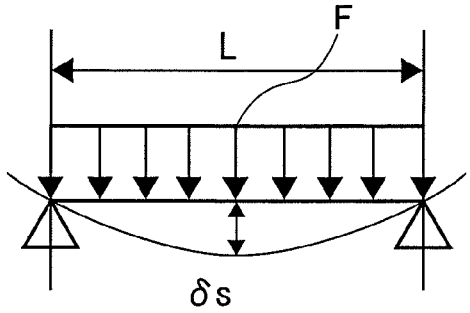
FIG. 5A is an explanation drawing of the deflection of a work roll.
Figure 5B:
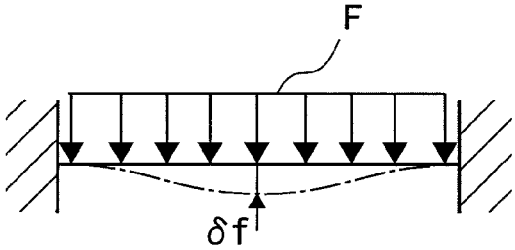
FIG. 5B is an explanation drawing of the deflection of the work roll.

As shown in FIG. 4, when driving torque is transmitted from the intermediate roll 3 to the work roll 2, driving tangential force F is exerted on the work roll 2. Since the number of the bearings for the conventional work roll is one each on the operating side and on the drive side, the supporting conditions for simple support shown in FIG. 5A apply. Deflection δs in the horizontal direction of the work roll in this case is expressed by the following equation (1), where F represents the driving tangential force per unit length, L represents the support spacing, Dc represents the diameter of the conventional work roll 2, Ic represents the second moment of area of the conventional work roll diameter, and Ec represents the modulus of longitudinal elasticity (21,000 kg/mm$^2$) of the material (special forging steel) of the conventional work roll:

$$\delta s = 5 \times F \times L^4 / (384 \times Ec \times Ic) \qquad \text{Equation (1)}$$

where $Ic = \pi \times Dc^4/64$

Similarly, in the case of Embodiment 1, the upper and lower work rolls as the pair are provided, on the operating side and the drive side, with the plurality of the supporting bearings arranged vertically zigzag on both of the entry side and the delivery side outside the rollable strip width. Thus, the supporting conditions for fixed support shown in FIG. 5B apply. Deflection f in the horizontal direction of the work roll in this case is expressed by the following equation (2), where Df represents the diameter of the work roll of Embodiment 1, and If represents the second moment of area of the diameter of the work roll of Embodiment 1:

$$\delta f = F \times L^4 / (384 \times Ec \times If) \qquad \text{Equation (2)}$$

where $If = \pi \times Df^4/64$

Assuming that δf=δs, Df is expressed by the following equation (3):

$$Df = Dc/5^{(1/4)} \qquad \text{Equation (3)}$$

Figure 6:
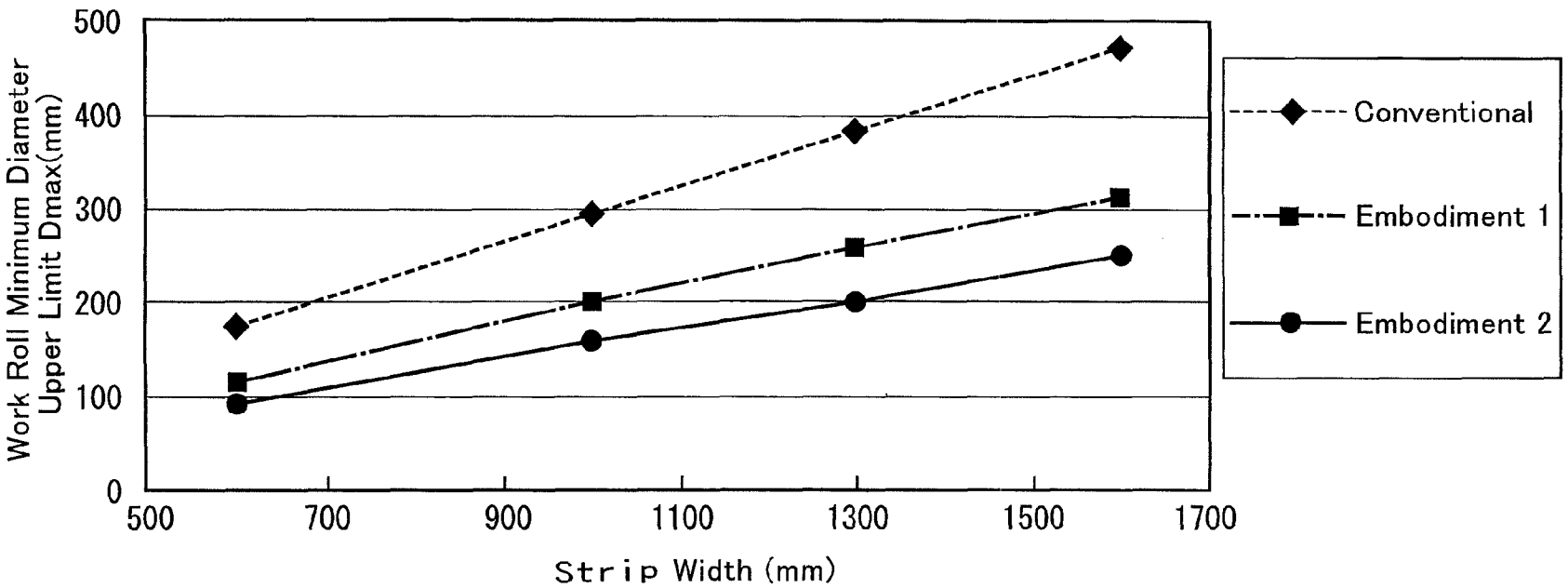
FIG. 6 is a graph showing the work roll minimum diameter upper limit Dmax in each of Embodiments 1 and 2 of the present invention.
Figure 7:
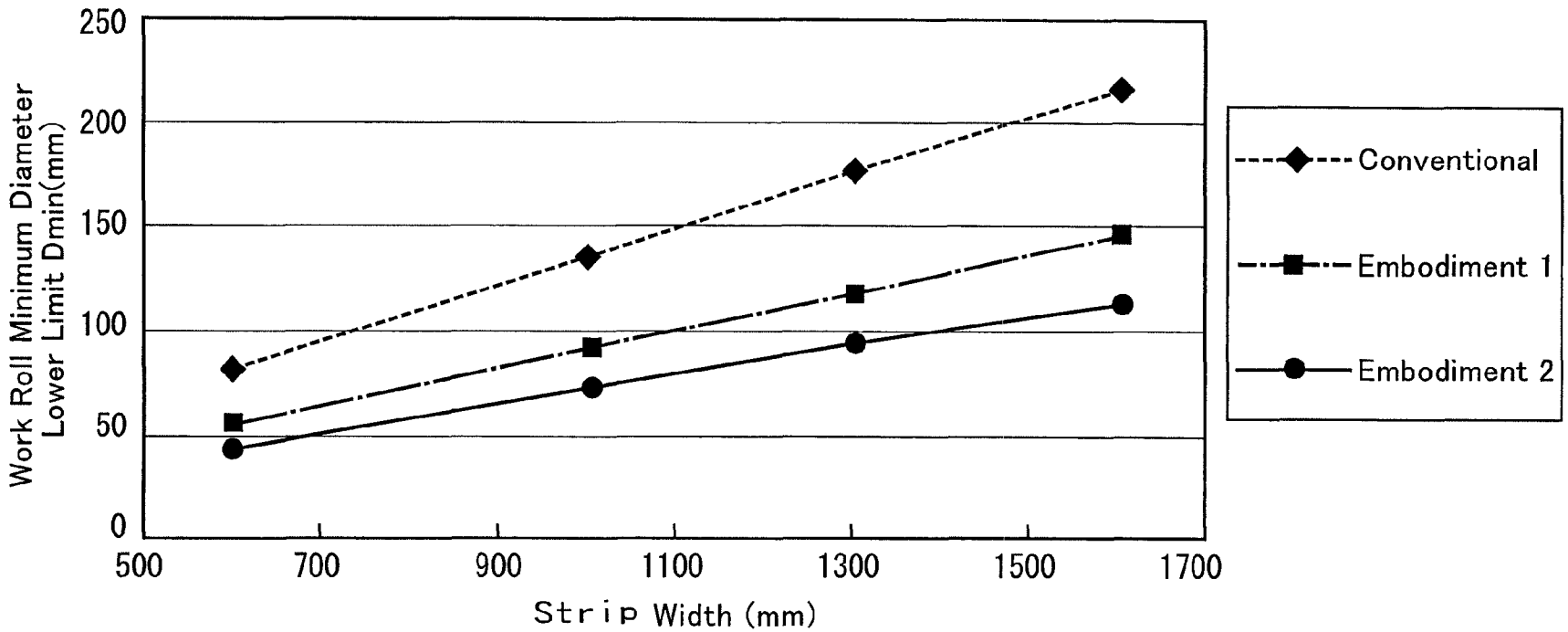
FIG. 7 is a graph showing the work roll minimum diameter lower limit Dmin in each of Embodiments 1 and 2 of the present invention.

On the other hand, the minimum roll diameter of the work roll is intermediate between the minimum diameter upper limit Dmax1 and the minimum diameter lower limit Dmin1, and these parameters are expressed by the equations indicated below based on the above equation (3).

$$\text{Minimum diameter upper limit Dmax1} = \text{D4max} \times B/5^{(1/4)} \qquad \text{Equation (4)}$$

where D4max; minimum diameter upper limit of conventional work roll with strip width of 1,300 mm: 380 mm B; strip width (mm)/1,300 mm The minimum diameter upper limit Dmax1 per strip width in Embodiment 1 is shown in FIG. 6.

$$\text{Minimum diameter lower limit Dmin1} = \text{D4min} \times B/5^{(1/4)} \qquad \text{Equation (5)}$$

where D4min; minimum diameter lower limit of conventional work roll with strip width of 1,300 mm: 180 mm The minimum diameter lower limit Dmin1 per strip width in Embodiment 1 is shown in FIG. 7.

In the case of Embodiment 2, the upper and lower work rolls are provided, on the operating side and the drive side, with the plurality of supporting bearings arranged vertically zigzag on both of the entry side and the delivery side at positions outward of the rollable strip width. Thus, the supporting conditions for fixed support shown in FIG. 5B apply. In addition, the material having a high modulus of longitudinal elasticity is used for the upper and lower work rolls 2 as the pair. An example of this material having a high modulus of longitudinal elasticity is a hard metal or a ceramic. Deflection δft in the horizontal direction of the work roll in this case is expressed by the following equation, where Dfr represents the diameter of the work roll 2 of Embodiment 2, Ifr represents the second moment of area of the diameter of the work roll of Embodiment 2, and Er represents the modulus of longitudinal elasticity of the material of the work roll of Embodiment 2:

$$\delta fr = F \times L^4/(384 \times Er \times Ifr) \quad \text{Equation (6)}$$

where $Ifr = \pi \times Dfr^4/64$

Assuming that $\delta fr = \delta s$, Dfr is expressed by the following equation (7):

$$Dfr = Dc/(5 \times K)^{(1/4)} \quad \text{Equation (7)}$$

On the other hand, the minimum roll diameter of the work roll is intermediate between the minimum diameter upper limit Dmax2 and the minimum diameter lower limit Dmin2, and these parameters are expressed by the following equation (8):

$$\text{Minimum diameter upper limit } Dmax2 = D4max \times B/(5 \times K)^{(1/4)} \quad \text{Equation (8)}$$

where D4max; minimum diameter upper limit of conventional work roll with strip width of 1,300 mm: 380 mm B; strip width (mm)/1,300 mm K; ratio for modulus of longitudinal elasticity of high longitudinal modulus material to conventional material (modulus of longitudinal elasticity of high longitudinal modulus material/modulus of longitudinal elasticity of conventional material (21,000 kg/mm$^2$))

The minimum diameter upper limit Dmax2 per strip width in Embodiment 2 is shown in FIG. 6. K=2.5, provided that the material of the work roll was a hard metal.

$$\text{Minimum diameter lower limit } Dmin2 = D4min \times B/(5 \times K)^{(1/4)} \quad \text{Equation (9)}$$

where D4min; minimum diameter lower limit of conventional work roll with strip width of 1,300 mm: 180 mm The minimum diameter lower limit Dmin2 per strip width in Embodiment 2 is shown in FIG. 7. K=2.5, provided that the material of the work roll was a hard metal.

Figure 8A:
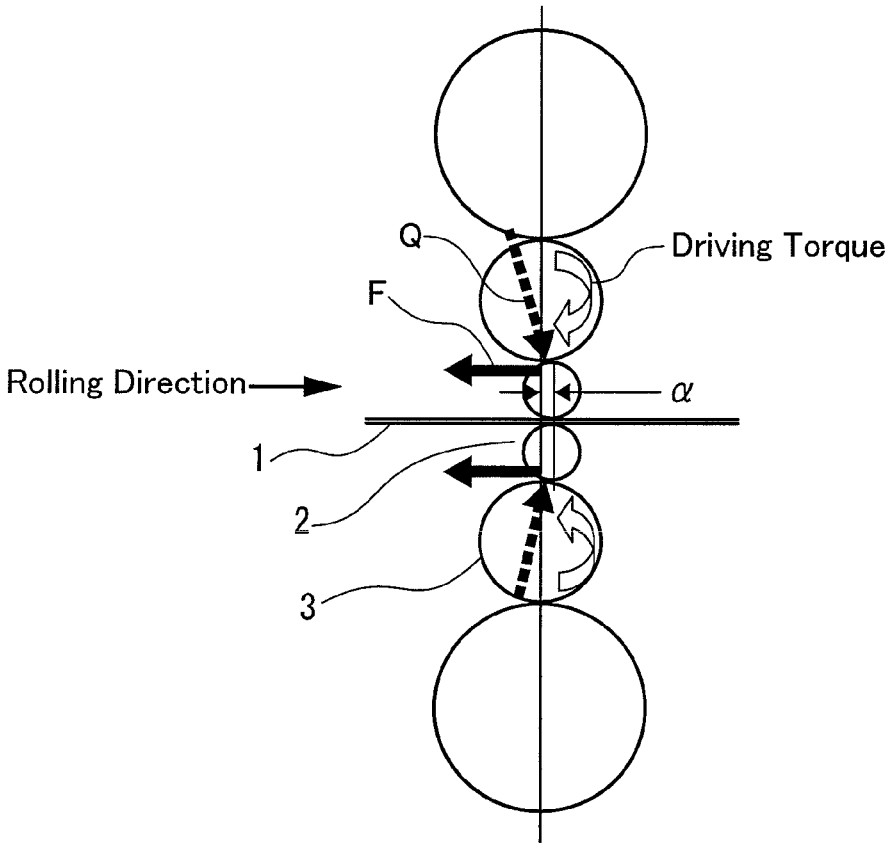
FIG. 8A is an explanation drawing of a work roll offset showing another embodiment of the present invention.
Figure 8B:
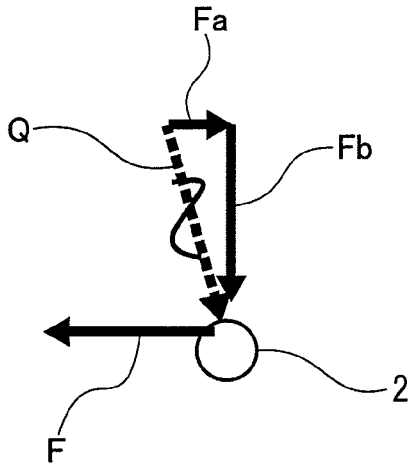
FIG. 8B is an explanation drawing of the work roll offset showing the another embodiment of the present invention.

As shown in FIGS. 8A and 8B, the work rolls 2 may be offset variably, according to the driving torque, toward the delivery side in the rolling direction in the horizontal direction. By so doing, the driving tangential force F is decreased by the offset horizontal component force Fa of the rolling load Q, so that the total force in the horizontal direction exerted on the work roll 2 is decreased. In FIG. 8B, Fb represents the offset vertical component force of the rolling load Q.

As a result, the advantage that the deflection of the work roll 2 can be diminished is produced.

The total force Fw in the horizontal direction exerted on the work roll 2 is expressed by the following equation (10):

$$Fw = F - Q \times \alpha/((Dw + DI)/2) \quad \text{Equation (10)}$$

where Dw represents the diameter of the work roll, and DI represents the diameter of the intermediate roll.

Figure 9A:
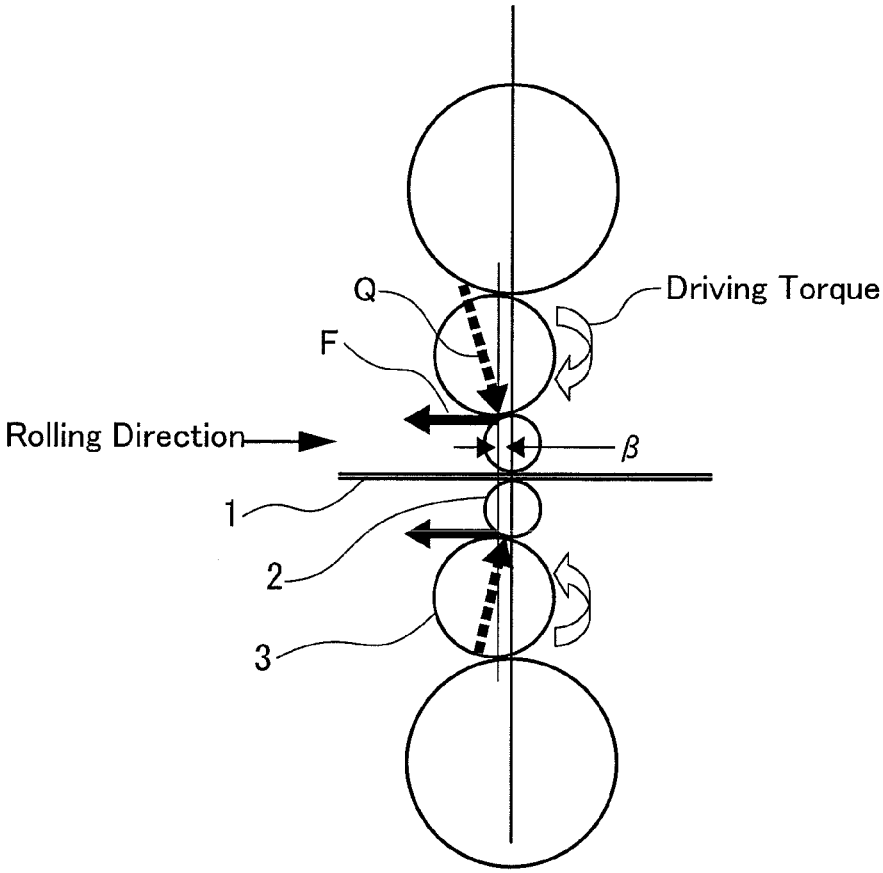
FIG. 9A is an explanation drawing of an intermediate roll offset showing still another embodiment of the present invention.
Figure 9B:
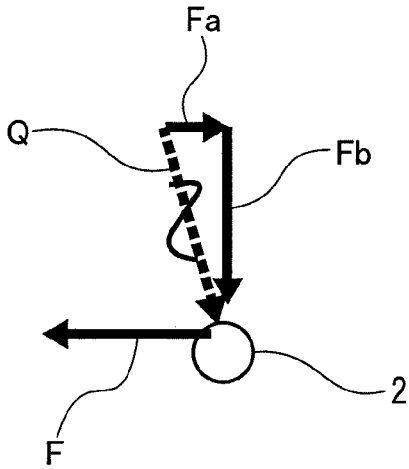
FIG. 9B is an explanation drawing of the intermediate roll offset showing the still another embodiment of the present invention.

As shown in FIGS. 9A and 9B, the intermediate rolls 3 may be offset variably, according to the driving torque, toward the entry side in the rolling direction in the horizontal direction. By so doing, the driving tangential force F is decreased by the offset horizontal component force Fa of the rolling load Q, so that the total force in the horizontal direction exerted on the work roll 2 is decreased. In FIG. 9B, Fb represents the offset vertical component force of the rolling load Q.

As a result, the advantage is produced that the deflection of the work roll 2 can be diminished.

The total force Fw in the horizontal direction exerted on the work roll 2 is expressed by the following equation (11):

$$Fw = F - Q \times \beta((Dw + DI)/2) \quad \text{Equation (11)}$$

where Dw represents the diameter of the work roll, and DI represents the diameter of the intermediate roll.

Figure 10:
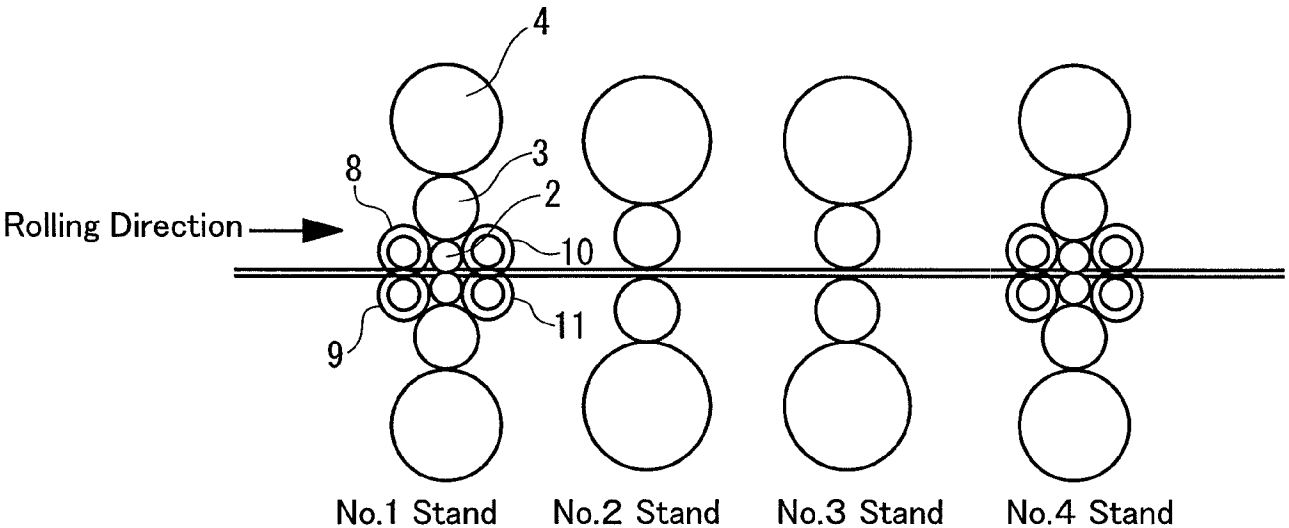
FIG. 10 is an explanation drawing of the application of the present invention to a tandem rolling mill.

If the rolling mill with small-diameter work rolls according to the present invention is applied to a tandem rolling mill, its application to No. 1 stand enables the small-diameter work rolls 2 to impart a great reduction in thickness, as shown in FIG. 10. When it is applied to the final stand, i.e., No. 4 stand in the drawing, a thinner plate can be rolled by the small-diameter work rolls 2. It goes without saying that the rolling mills with the small-diameter work rolls 2 according to the present invention may be applied to all of No. 1 stand to No. 4 stand. This makes it possible to roll a thinner, harder material.

INDUSTRIAL APPLICABILITY

The rolling mill and a tandem rolling mill equipped with it, according to the present invention, is preferred when used as a heavy load, high torque rolling mill for a hard material.

The invention claimed is:

1. A six-high rolling mill including upper and lower work rolls as a pair for rolling a metal strip, upper and lower intermediate rolls as a pair for supporting the work rolls, and upper and lower back-up rolls as a pair for supporting the upper and lower intermediate rolls as the pair, the six-high rolling mill having no supporting rolls inside a rollable strip width of the work rolls, the six-high rolling mill comprising a plurality of supporting rollers or supporting bearings, which support the upper and lower work rolls, provided at predetermined spacings in a roll axis direction on both of an entry side and an delivery side on an operating side and a drive side outside the rollable strip width of the upper and lower work rolls as the pair such that the supporting rollers or supporting bearings are arranged vertically zigzag between the upper and lower work rolls as the pair.

2. The rolling mill according to claim 1, wherein a minimum roll diameter of the work rolls is between a minimum diameter upper limit Dmax1 and a minimum diameter lower limit Dmin1, wherein the minimum diameter upper limit $Dmax1 = D4max \times B/5^{(1/4)}$, where D4max is about 380 mm, corresponding to a conventional minimum diameter upper limit of a work roll with strip width of about 1,300 mm;

B is a strip width of the work rolls (mm)/1,300 mm, the minimum diameter lower limit $Dmin1 = D4min \times B/5^{(1/4)}$, where D4min is about 180 mm, corresponding to a conventional minimum diameter lower limit of a work roll with strip width of about 1,300 mm.

3. The rolling mill according to claim 1, wherein a material having a high modulus of longitudinal elasticity is used for the work rolls, and a minimum roll diameter of the work rolls is between a minimum diameter upper limit Dmax2 and a minimum diameter lower limit Dmin2, wherein:

the minimum diameter upper limit $Dmax2 = D4max \times B/(5 \times K)^{(1/4)}$, where D4max is about 380 mm, corresponding to a conventional minimum diameter upper limit of a work roll with strip width of about 1,300 mm: 380 mm;

B is a strip width (mm) of the work rolls/1,300 mm, and

K is the ratio for modulus of longitudinal elasticity of the high longitudinal modulus material to a material with conventional modulus of longitudinal elasticity of about 21,000 $kg/mm^2$, and the minimum diameter lower limit $Dmin2=D4min \times B/(5 \times K)^{(1/4)}$, where D4min is about 180 mm, corresponding to a conventional minimum diameter lower limit of a work roll with strip width of about 1,300 mm.

4. A tandem rolling mill including a plurality of rolling mill stands arranged therein, wherein the rolling mill according to claim 1 is provided as at least one of the stands.

5. A tandem rolling mill including a plurality of rolling mill stands arranged therein, wherein the rolling mill according to claim 2 is provided as at least one of the stands.

6. A tandem rolling mill including a plurality of rolling mill stands arranged therein, wherein the rolling mill according to claim 3 is provided as at least one of the stands.

* * * * *